United States Patent [19]

Hoffman

[11] Patent Number: 4,548,572

[45] Date of Patent: Oct. 22, 1985

[54] SOAP SAVING RACK

[76] Inventor: Edward C. Hoffman, 4 Kane Ct., Clarendon Hills, Ill. 60514

[21] Appl. No.: 613,624

[22] Filed: May 24, 1984

[51] Int. Cl.[4] ..... B29C 3/00; B29C 27/00

[52] U.S. Cl. ..... 425/410; 100/265; 206/77.1

[58] Field of Search ..... 425/410, 177, 318, 355, 425/DIG. 35, DIG. 54, DIG. 127, DIG. 128, 425/DIG. 131; 206/77.1; 100/265, 915; 17/32

[56] References Cited

U.S. PATENT DOCUMENTS

| | | | |
|---|---|---|---|
| 339,376 | 4/1886 | Christy | 425/410 |
| 1,782,076 | 11/1930 | Safford | 425/318 |
| 2,101,528 | 12/1937 | Bjorklund | 425/DIG. 131 X |
| 2,486,347 | 10/1949 | Walker | 425/410 |
| 2,641,094 | 6/1953 | Starzyk | 17/32 |
| 2,975,485 | 3/1961 | Wendt | 264/308 |
| 3,083,651 | 4/1963 | Cooper | 17/32 |
| 3,222,723 | 12/1965 | Boggild et al. | 425/410 |
| 3,548,741 | 12/1970 | Wiley | 100/265 |
| 4,035,122 | 7/1977 | Cavanaugh | 425/410 |
| 4,331,232 | 5/1982 | Larkin | 206/77.1 |
| 4,344,529 | 8/1982 | Ikarzakal | 425/410 |
| 4,435,030 | 3/1984 | Haven | 206/77.1 |

*Primary Examiner*—Jay H. Woo
*Assistant Examiner*—Joye Woodard
*Attorney, Agent, or Firm*—A. G. Douvas

[57] ABSTRACT

A soap saving device for pressure bonding two or more pieces of wet soap comprising a rack particularly adapted for hanging in a shower or bath stall. The rack carries two or more soap trays with at least one tray being fixedly supported on the rack and another tray being moveable relative the rack. An elastic element, such as a rubber band or spring, can drive the moveable tray toward the fixed tray when an operate latch is disengaged in a first species. If two or more pieces of wet soap are stacked between the two trays, a pressure bonding force can be applied to the soap pieces to mold the several pieces into a single bar. The operate latch is dispensed within a second species, and the elastic element is manually extended momentarily to enable the moveable soap tray to be separated so that the two or more pieces of wet soap can be placed on the moveable tray for pressure bonding.

12 Claims, 9 Drawing Figures

SOAP SAVING RACK

The present invention relates to apparatus for conserving soap, and in particular to a rack supported set of soap trays particularly adapted for hanging in a shower or bath stall with the soap trays being capable of pressure bonding two or more pieces of wet soap.

A bar of soap is rarely fully used. The thin slivers remaining after extensive use of a soap bar usually dry out and break into small unwieldy pieces which are generally thrown away.

Devices for pressure bonding two pieces of soap are disclosed in the prior art. U.S. Pat. Nos. 4,344,529, 2,975,485, 2,486,347, and 339,376 disclose typical prior art structures. While all of these devices are effective to bond pieces of soap, they have limited utility for other applications. This limited utility and the relatively high cost to manufacture the individual components and to assemble them into a working combination have prevented the extensive use of soap saving devices in the home and elsewhere.

Accordingly, a principal object of this invention is to provide improved apparatus for pressure bonding pieces of soap. This apparatus is characterized by a simple design that enables the apparatus to be employed as soap-holding trays, particularly in a shower or bath stall, and therefore having day-to-day utility.

A principal embodiment of the invention comprises a rack adapted for hanging in a shower or a bath stall. The rack carries two or more soap trays with at least one tray being fixedly supported on the rack and another tray being moveable relative the rack.

An elastic element, such as a rubber band or spring, can drive the moveable tray toward the fixed tray when an operate latch is disengaged in a first species. If two or more pieces of wet soap are stacked between the two trays, a pressure bonding force can be applied to the soap pieces to mold the several pieces into a single bar.

The operate latch is dispensed with in a second species, and the elastic element is manually extended momentarily to enable the moveable soap tray to be separated so that the two or more pieces of wet soap can be placed on the moveable tray for pressure bonding without operation of an operate latch.

DESCRIPTION OF THE DRAWINGS

In order that all of the structural features for attaining the objects of this invention may be readily understood, reference is herein made to the accompanying drawings wherein.

DESCRIPTION OF THE PREFERRED EMBODIMENTS

Figure 1:
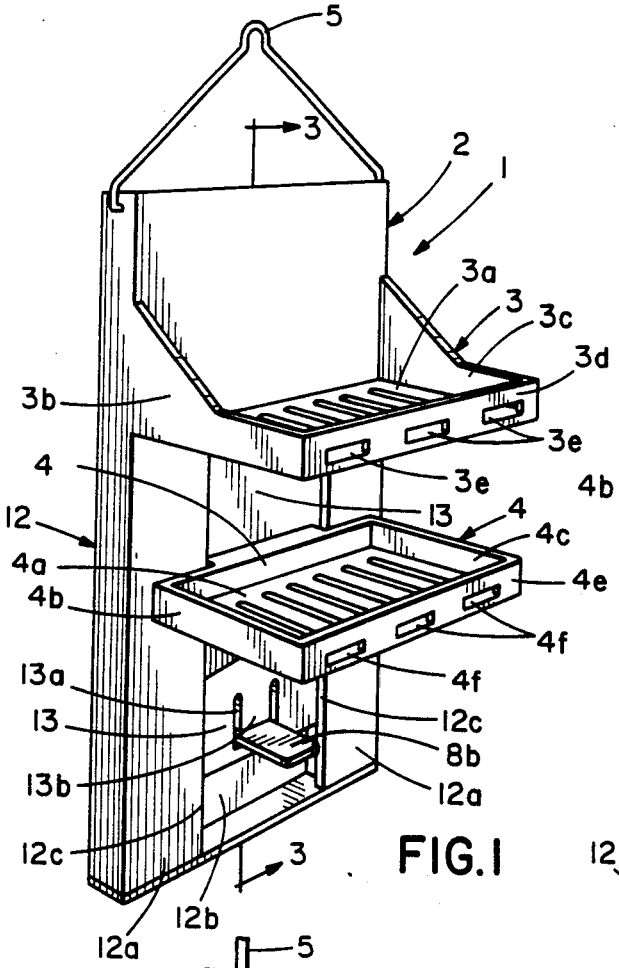
FIG. 1 is a perspective view of a first preferred embodiment of the soap saving rack of this invention employing manual latch control of the tray which will carry the pieces of soap to be pressure bonded.
Figure 2:
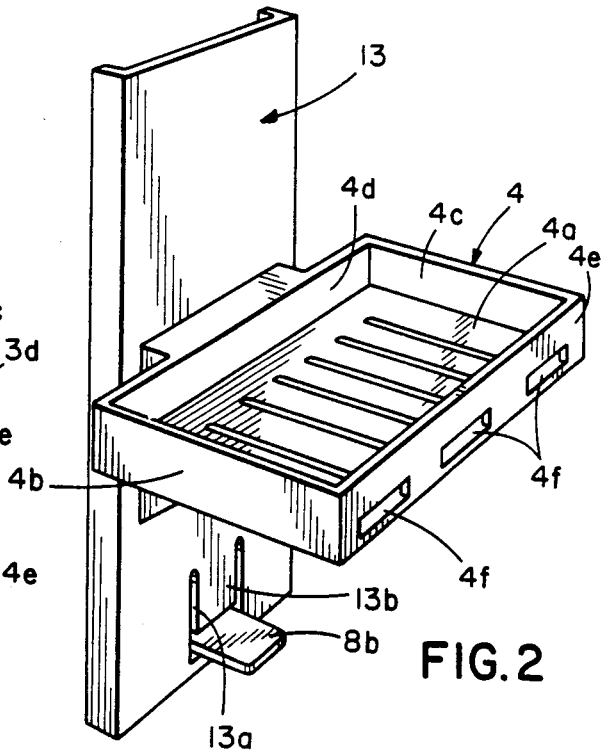
FIG. 2 is a perspective view of the moveable channel section and the bottom soap tray which is fixed to the channel section.

A first preferred embodiment of the soap saving rack 1 of this invention is shown in FIGS. 1–6 of the drawings. This embodiment features a hanging rack 2 which supports a fixed soap tray 3 and a moveable soap tray 4. Soap saving rack 1 is preferably hung in a shower or bath stall by passing wire or plastic hanger 5 over a shower head or a wall supported hook (not shown).

In this environment, both trays 3 and 4 can be used on a day-to-day basis as a caddy for holding one or more soap bars. When desired, however, rack 1 can also be used to pressure bond a wet soap sliver 6 to a larger bar of soap 7 (FIG. 3) by stacking both pieces of soap on moveable soap tray 4. As later described in detail, when manually operated latch 8 is actuated thereby disengaging pivoted catch 8*a* from stationary catch 9 (FIG. 5) by manually depressing tab 8*b*, elastic band 11 elevates moveable tray 4 (FIG. 6) to apply a pressure bonding force to wet soap pieces 6 and 7 by clamping these pieces between soap trays 3 and 4.

Soap saving rack 1 comprises a generally rectangular, hollow, main frame 12 (FIG. 4), the lower portion of the front panel 12*a* of which is formed with a rectangular slot 12*b* (FIG. 4) defined by vertically disposed slot edges 12*c* and bottom 3*a* of fixed soap tray 3.

Figure 4:
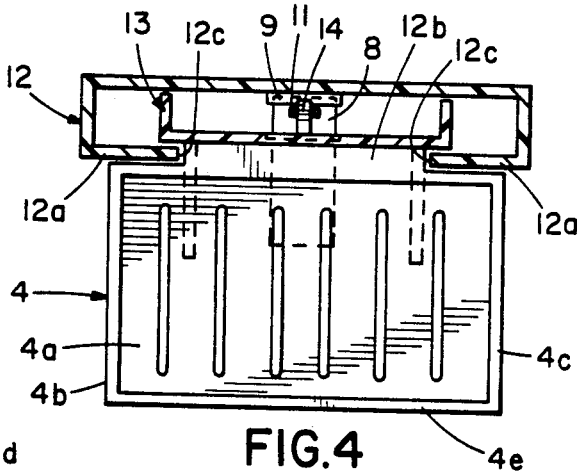
FIG. 4 is a section view taken along line 4—4 of FIG. 3 with the soap pieces removed from the lower tray.
Figure 5:
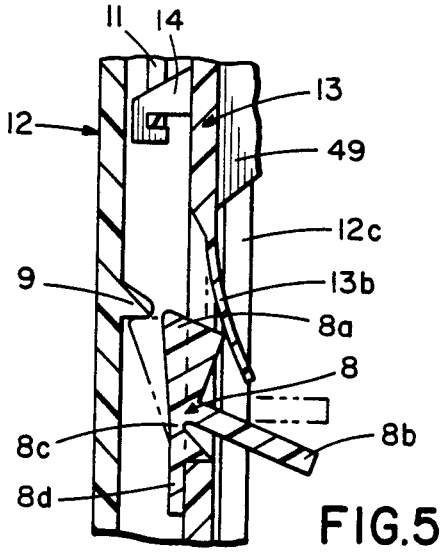
FIG. 5 is a partial section view related to FIGS. 3 and 6 showing the manual latch in a disengaged position to release the moveable channel and the lower soap tray.

Rectangular slot 12*b* serves as a guide for moveable C-channel 13 which is housed within the central hollow or bore of frame 12 (FIG. 4). Soap tray 4 is integrally attached to channel 13, and therefore the two parts move together. In particular, hook 14 is fixed to the lower interior backside of channel 13 and hook 15 is fixed to the upper interior backside of main frame 12 (FIGS. 3, 6), and elastic band 11 extends between the two hooks so that channel 13 and lower tray 4 are elevated (FIG. 6) when latch 8 is disengaged from catch 9 (FIG. 5).

Figure 3:
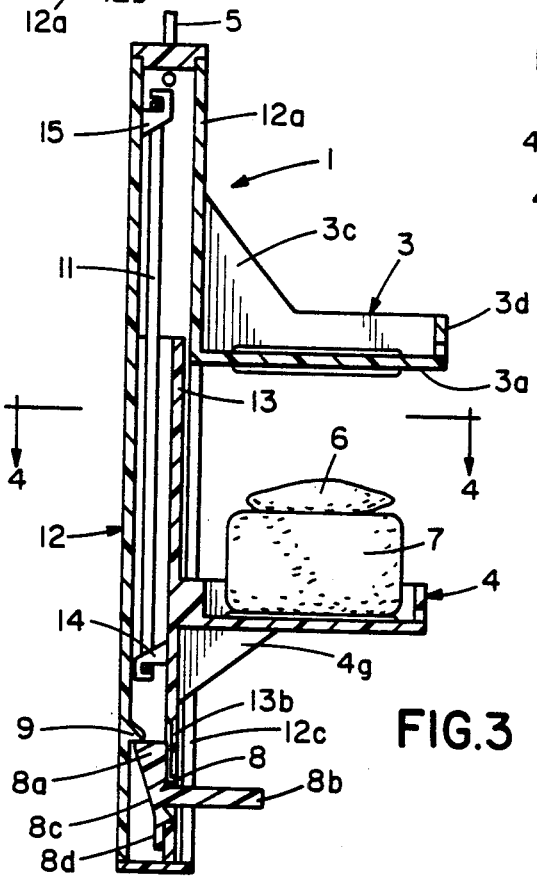
FIG. 3 is a section view taken along line 3—3 of FIG. 1 showing the lower moveable tray latched into its normal non-operate position and carrying two pieces of soap to be pressure bonded together.

All of the components of soap saving rack 1 may be satisfactorily fabricated from a plastic material so that the components will not rust or oxidize when subjected to the humid environment of a shower or bath stall. In any event, channel 13 and manually operated latch 8 must be constructed at least in part from a flexible material because both components contain flexible elements. Channel 13 is formed with a U-shaped slot 13*a* which serves two functions. Slot 13*a* defines flexible flap 13*b* which normally biases pivoted catch 8*a* into engagement with stationary catch 9 to hold lower tray 4 in its lowermost position (FIG. 3). The horizontal segment of slot 13*a* also receives and holds operate tab 8*b* in a normal projecting position relative to the front face of channel 13.

Latch 8 is formed with a flexible hinge point 8*c* which enables pivoted catch 8*a* to move into and out of engagement with stationary catch 9 while hinge base 8*d* serves as a hinge support by nesting against the interior surface of channel 13.

Fixed soap tray 3 includes a pair of side panels 3*b* and 3*c* which are integrally attached to main frame 12. Side panels 3*b* and 3*c* are joined by front panel 3*d*. Front panel 3*d* is formed with a set of drainage openings 3*e* to facilitate the removal of water from tray 3.

Moveable soap tray 4 includes a bottom 4*a*, and a pair of side panels 4*b* and 4*c* which are joined by back panel 4*d* and front panel 4*e*. Front panel 4*e* is formed with a set of drainage openings 4*f* to facilitate the removal of water from tray 4. A set of reinforcing braces 4*g* serves as reinforcing supports for tray 4 on moveable channel 13.

Figure 6:
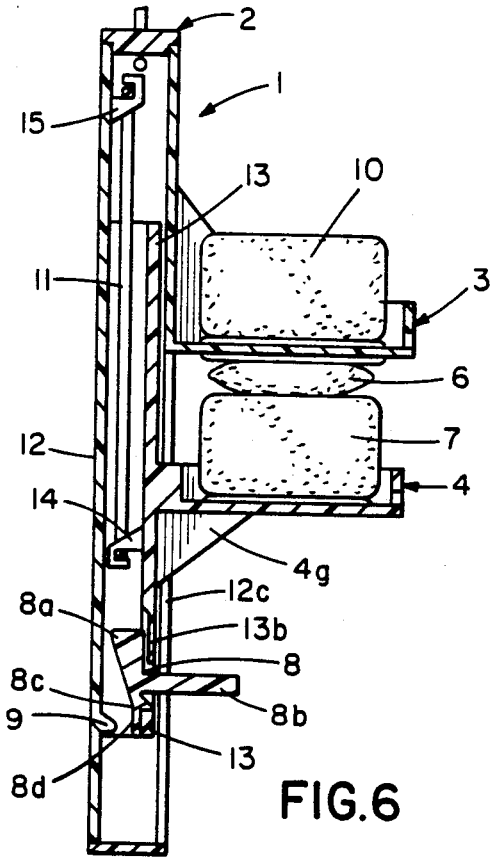
FIG. 6 is a section view related to FIGS. 3 and 5 showing the released lower soap tray in its elevated position to pressure bond two pieces of soap.

Tray 3 is shown in FIG. 6 carrying a bar of soap 10 for routine use.

Figure 7:
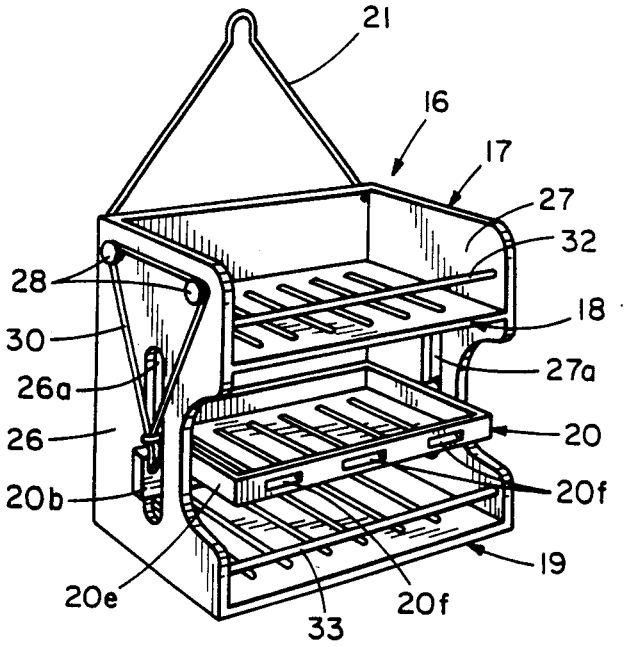
FIG. 7 is a perspective view of a second preferred embodiment of the soap saving rack of this invention which does not employ a manual latch to control the movement of a tray which will carry the pieces of soap to be pressure bonded.
Figure 8:
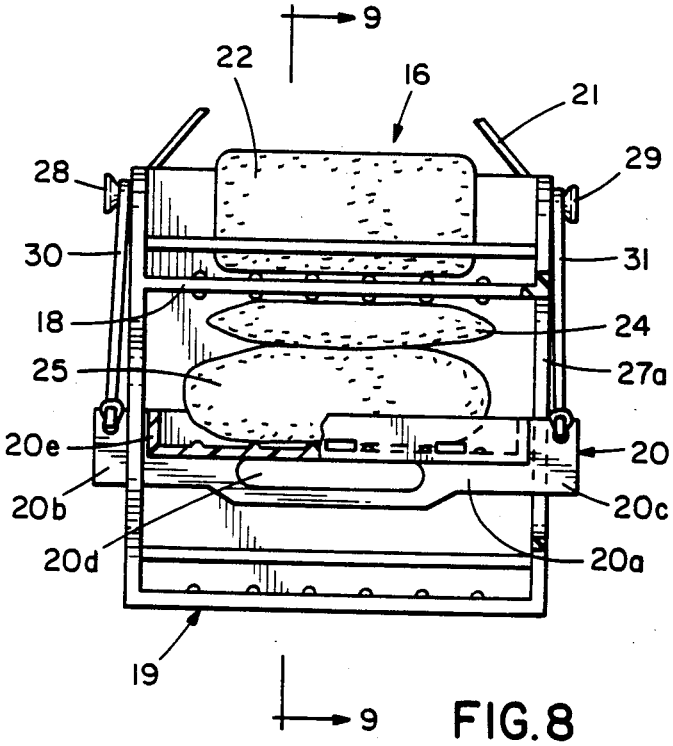
FIG. 8 is a front elevation view with the intermediate moveable tray being partly in section and supporting two pieces of wet soap in the pressure bonding position.
Figure 9:
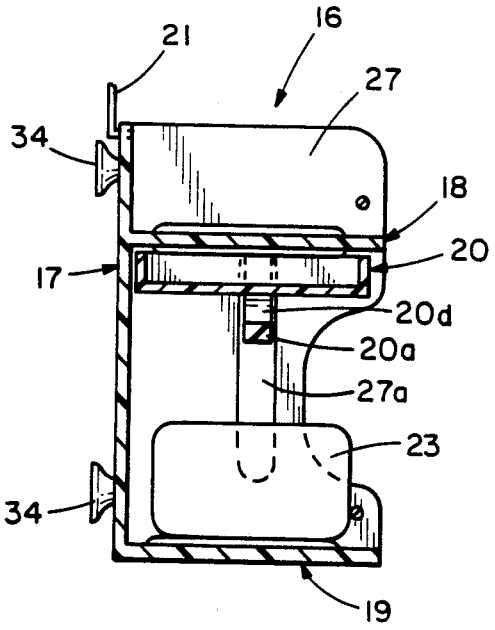
FIG. 9 is a section view taken along line 9—9 of FIG. 8 and showing the intermediate tray positioned in its normal non-operate position, or storage position against the upper tray.

A second preferred embodiment of this invention is shown in FIGS. 7–9. In this embodiment, soap saving rack 16 features a hanging rack 17 which supports two fixed soap trays 18 and 19 and a moveable soap tray 20 which is located between the two fixed trays. Soap saving rack 16 is also preferably hung in a shower or bath stall by passing wire or plastic hanger 21 over a shower head or a wall supported hook (not shown).

Both trays 18 and 19 can be used routinely as a soap caddy by placing one or more bars of soap 22 (FIG. 8) or 23 (FIG. 9) in either or both of fixed trays 18 and 19. When desired, however, rack 16 can be used to pressure bond a wet soap sliver 24 to a larger bar of soap 25 by stacking both pieces of soap on moveable soap tray 20 (FIG. 8).

Soap saving rack 16 differs from soap saving rack 1 in that rack 16 has no latch, such as latch 8 which must be manually operated in order to effect pressure bonding of soap pieces. In the second embodiment of FIGS. 7–9, soap tray 20 includes an integral tray carrier 20*a* (FIG. 8) whose ends 20*b* and 20*c* extend through elongated slots 26*a* and 27*a* formed in rack side panels 26 and 27, respectively. A pair of separated pin supports 28 are fixed to the upper portion of side panel 26, and a pair of similar pin supports 29 are fixed to side panel 27. An elastic band 30 is looped over pin supports 28 and is tied to tray carrier end 20*b*, and elastic band 31 is looped over pin supports 29 and is tied to tray carrier end 20*c*. Elastic bands 30 and 31 are adjusted so that the balanced elasticity of both bands normally draws moveable tray 20 into contacting engagement with tray 18 (FIG. 9). This is the normal storage position for tray 20 when soap saving device 16 is used as a soap caddy. Alternatively, a spring or other tension producing elements could be substituted for elastic band 30.

When it is desired to pressure bond two or more pieces of soap, the handle formed in tray carrier 20*a* by slot 20*d* is manually engaged and the tray is lowered as is shown in FIG. 8 and wet soap pieces 24 and 25 are stacked on tray 20. When the manual holding force on tray 20 is released, soap pieces 24 and 25 are forcibly sandwiched between fixed tray 18 and moveable tray 20 by the forces developed by elastic bands 30 and 31, and are thereby bonded into a single piece.

Tray 20 is formed with a peripheral sidewall 20*e*, the front of which contains a set of drainage slots 20*f*. Fixed trays 18 and 19 have open fronts which facilitate drainage. Soap pieces are confined to trays 18 and 19 by plastic rods 32 and 33, respectively. Soap saving rack 16 is also preferably formed of plastic.

A set of optional suction cups 34 is perferably located on the back of hanging rack 17 in order to attain a stable position on a wall or the like.

It should be understood that the above described preferred embodiments are merely illustrative of the principles of the invention and that modifications can be made without departing from the scope of the invention.

What is claimed is:

1. A soap saving device for pressure bonding two or more pieces of soap, comprising a frame supportable on a wall, a first soap tray fixed to and supported by the frame, means including a second soap tray moveable relative to both the first soap tray and the frame and also supported by the frame, means when disengaged moving the second soap tray toward the first soap tray to cause the two soap trays to clamp forcibly therebetween two or more pieces of soap stacked on the second tray to exert a pressure bonding force causing the two pieces of soap to bond to one another, and means for disengaging the means for moving the second soap tray toward the first soap tray.

2. The soap saving device of claim 1 in which the frame is a hanging rack.

3. The soap saving device of claim 2 in which the moving means includes an elastic element.

4. The soap saving device of claim 3 in which the hanging rack has a generally vertically disposed flat surface when the soap saving device is in an operating position, and the two trays each include a generally horizontal soap supporting surface.

5. The soap saving device of claim 4 in which the disengaging means is a manually operated latch.

6. A soap saving device for pressure bonding two or more pieces of soap comprising a frame supportable on a wall, a first soap tray fixed to and supported by the frame, means including a second soap tray moveable relative to both the first soap tray and the frame and also supported by the frame, and means moving the second soap tray toward the first soap tray to cause the two soap trays to clamp forcibly therebetween two or more pieces of soap stacked between the two trays to exert a pressure bonding force causing the two pieces of soap to bond to one another.

7. The soap saving device of claim 6 including a third soap tray fixed to and supported by the frame with the second soap tray being moveably disposed between the first and third soap trays.

8. The soap saving device of claim 6 including means for preventing the moving means from operating to move the second soap tray toward the first soap tray.

9. The soap saving device of claim 7 in which the moving means includes an elastic element.

10. The soap saving device of claim 9 in which the frame is a hanging rack.

11. The soap saving device of claim 10 in which the hanging rack has a generally vertically disposed flat surface when the soap saving device is in an operating position, and each of the trays includes a generally horizontal soap supporting surface.

12. The soap saving device of claim 11 in which the hanging rack is formed with one or more slots which serve as a guide for the second moveable soap tray.

* * * * *